US007695316B2

(12) United States Patent
Sun

(10) Patent No.: US 7,695,316 B2
(45) Date of Patent: Apr. 13, 2010

(54) ELECTRICAL CONNECTOR ASSEMBLY

(75) Inventor: Zheng-Heng Sun, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 103 days.

(21) Appl. No.: 11/946,856

(22) Filed: Nov. 29, 2007

(65) Prior Publication Data

US 2008/0261461 A1 Oct. 23, 2008

(30) Foreign Application Priority Data

Apr. 20, 2007 (CN) ..... 2007 1 0200491

(51) Int. Cl.
*H01R 13/40* (2006.01)

(52) U.S. Cl. ..... 439/594; 439/717

(58) Field of Classification Search ..... 439/717, 439/594

See application file for complete search history.

(56) References Cited

U.S. PATENT DOCUMENTS 4,477,194 A * 10/1984 Michel et al. ..... 368/69
5,997,325 A * 12/1999 Hara ..... 439/159
6,146,164 A * 11/2000 Tung ..... 439/159
6,375,517 B1 * 4/2002 Okabe et al. ..... 439/701
6,719,591 B1 * 4/2004 Chang ..... 439/638
7,316,582 B2 * 1/2008 Fan ..... 439/540.1
2001/0049216 A1 12/2001 Torii et al.
2004/0127101 A1 * 7/2004 Zhou ..... 439/630

FOREIGN PATENT DOCUMENTS

CN 2153868 Y 1/1994
CN 2604794 Y 2/2004
CN 2821899 Y 9/2006
DE 8905052 U1 7/1989

* cited by examiner

*Primary Examiner*—Tho D Ta
*Assistant Examiner*—Travis Chambers
(74) *Attorney, Agent, or Firm*—Frank R. Niranjan

(57) ABSTRACT

An electrical connector assembly includes a first electrical connector, a second electrical connector, and a connecting member. The first electrical connector includes an insulative main body with a receiving recess defined therein. The second electrical connector includes an insulative main body with a receiving recess defined therein. The connecting member is slidably engaged in the receiving recess of the first electrical connector and is configured for being slidably engaged in the receiving recesses of the first and second connectors simultaneously, thereby combining the first and second connectors together.

8 Claims, 5 Drawing Sheets

ELECTRICAL CONNECTOR ASSEMBLY

BACKGROUND

1. Field of the Invention

The present invention relates to an electrical connector assembly, and more particularly to an electrical connector assembly providing reliable mechanical interconnection.

2. Description of Related Art

There exists in the art an electrical connector known as a serial advanced technology attachment (serial ATA) connector which is generally used for disk drives and other storage peripherals. The serial ATA connectors according to the serial ATA standard feature fewer electrical contacts than other conventional electrical connectors and are relatively tiny in configuration. In use, there are problems with the cable end serial ATA connectors being easily loosened, and even become accidentally disengaged from the corresponding mating connectors by external forces, and so the interconnection between the cable end serial ATA connectors and the corresponding mating connectors of disk drives or other storage peripherals is unreliable.

Generally, the cable end serial ATA connector includes a power connector and a separate signal connector. Hence, if the power connector and the signal connector could be combined together via some coupling member, the power connector and the signal connector would not so easily be removed from the corresponding mating connectors by accident.

What is desired, therefore, is an electrical connector assembly with the power and signal connectors combined together to provide reliable mechanical interconnection.

SUMMARY

An exemplary electrical connector assembly comprises a first electrical connector, a second electrical connector, and a connecting member. The first electrical connector comprises an insulative main body with a receiving recess defined therein. The second electrical connector comprises an insulative main body with a receiving recess defined therein. The connecting member is slidably engaged in the receiving recess of the first electrical connector and is configured for being slidably engaged in the receiving recesses of the first and second connectors simultaneously, thereby combining the first and second connectors together.

Other advantages and novel features of the present invention will become more apparent from the following detailed description of an embodiment when taken in conjunction with the accompanying drawings, in which:

DETAILED DESCRIPTION

Figure 1:
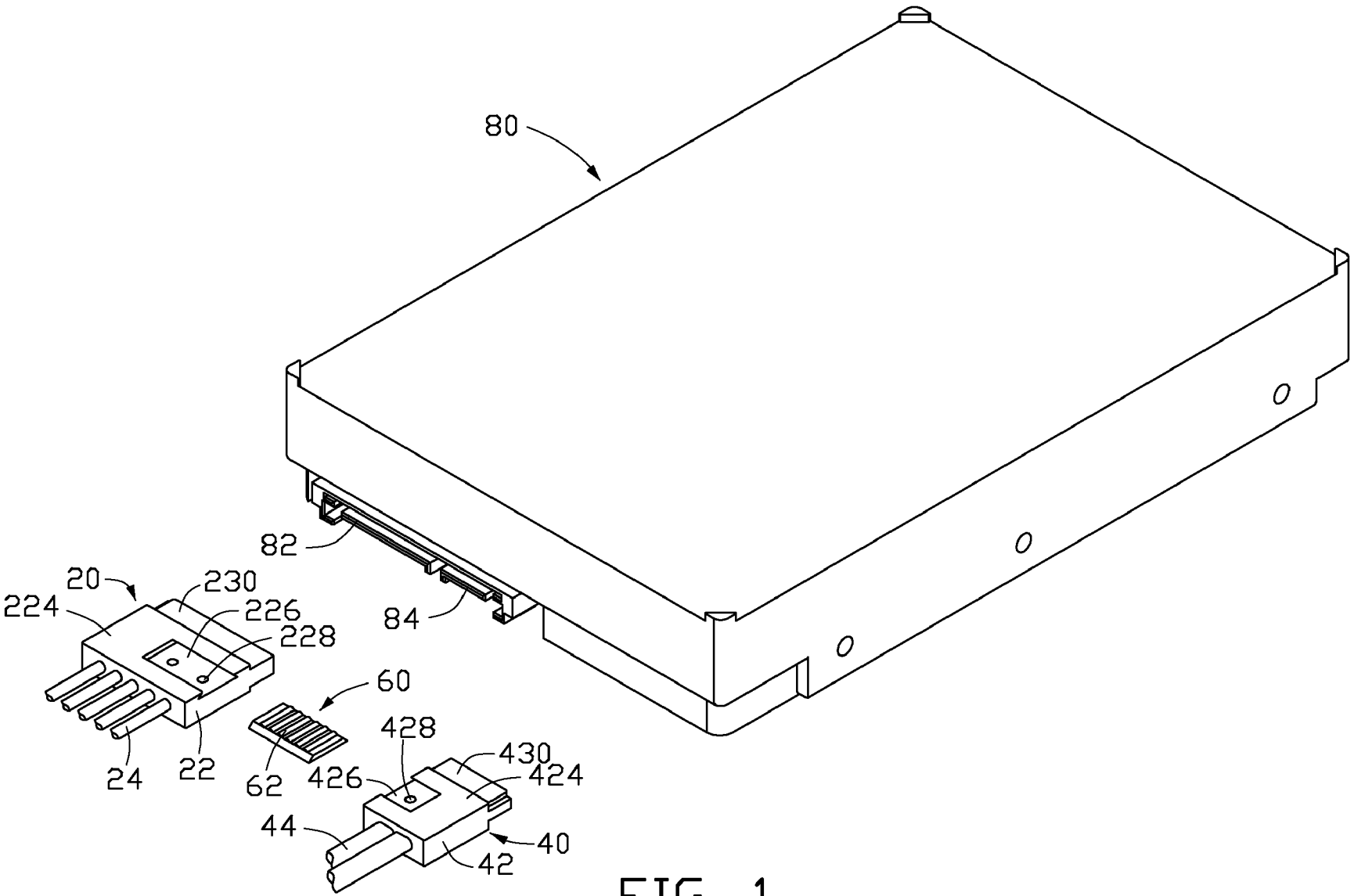
FIG. 1 is an exploded, isometric view of an electrical connector assembly according to a first embodiment, together with an electronic device, the electrical connector assembly including a first female connector, a second female connector, and a connecting member.
Figure 2:
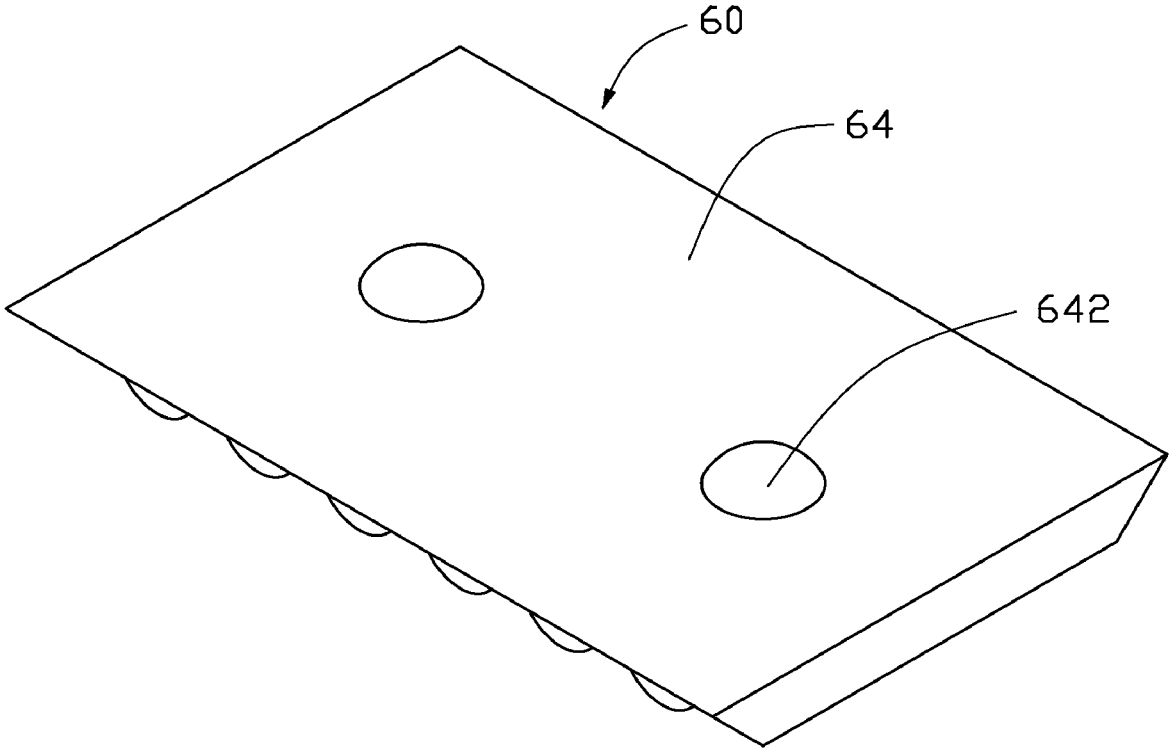
FIG. 2 is an inverted view of the connecting member of FIG. 1.

Referring to FIGS. 1 and 2, in a first embodiment, an electrical connector assembly includes a first female connector 20, a second female connector 40, and a connecting member 60. The electrical connector assembly could be connected to an electronic device, such as a hard disk drive 80, via the first and second female connectors 20, 40 being respectively connected with a first male connector 82 and a second male connector 84 thereof, thereby providing electric power and electrical signals for the hard disk drive 80.

The first male connector 82 of the hard disk drive 80 is neighboring the second male connector 84. Two electrical plugs respectively extend from the first and second male connectors 82, 84.

The first female connector 20 includes an insulative main body 22 and a plurality of power cables 24 extending from a back end thereof. A hollow tubular head 230 is formed at a front end of the main body 22 to receive the electrical plug of the first male connector 82. A plurality of contact terminals (not visible) is disposed inside the head 230. The cables 24 are electrically connected with the contact terminals of the head 230. A receiving recess 226 is defined in a top surface 224 of the main body 22, adjacent a side thereof. The receiving recess 226 has a dovetail-shaped cross-section. Two spaced positioning holes 228 are defined in a bottom surface of the receiving recess 226.

The width of the second female connector 40 is narrower than that of the first female connector 20. The second female connector 40 includes an insulative main body 42 and a plurality of signal cables 44 extending from a back end thereof. A hollow tubular head 430 is formed at a front end of the main body 42 to receive the electrical plug of the second male connector 84. A plurality of contact terminals (not visible) is disposed inside the head 430. The cables 44 are electrically connected with the contact terminals of the head 430. A receiving recess 426 is defined in a top surface 424 of the main body 42, adjacent a side thereof. The receiving recess 426 has a dovetail-shaped cross-section and is opposite to the receiving recess 226 of the first female connector 20. A positioning hole 428 is defined in a bottom surface of the receiving recess 426.

The connecting member 60 has a dovetail-shaped cross-section to be engaged in the receiving recesses 226, 426 of the first and second female connectors 20, 40. The length of the connecting member 60 is generally equal to that of the receiving recess 226 of the first female connector 20. A finger portion 62 including a plurality of parallel ribs is formed at a top surface of the connecting member 60, to facilitate fingers pushing the connecting member 60. Two spaced protrusions 642 are formed at a bottom surface 64 of the connecting member 60 corresponding to the two positioning holes 228 of the receiving recess 226 of the first female connector 20.

Figure 3:
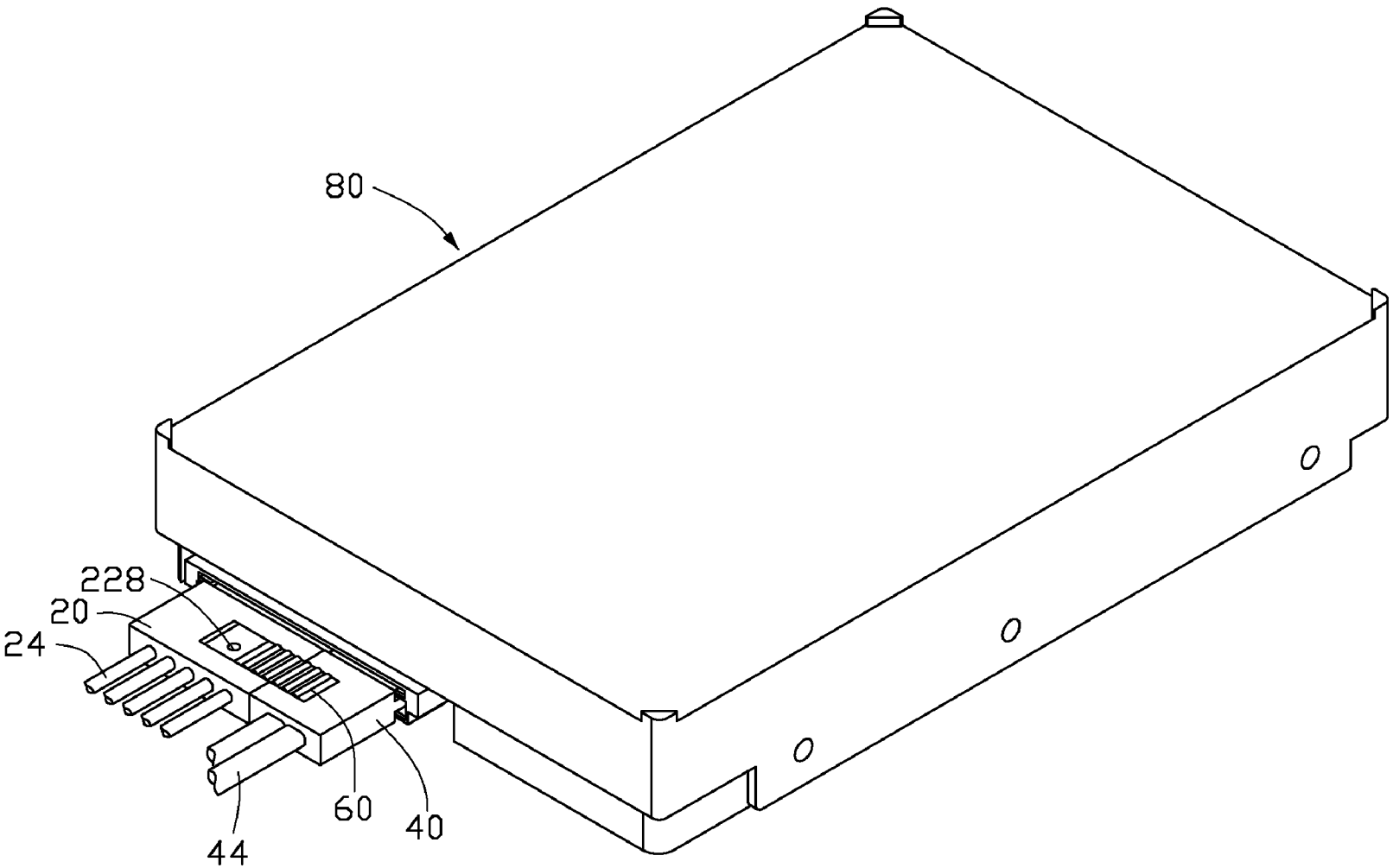
FIG. 3 is an assembled view of FIG. 1.

Referring also to FIG. 3, in use, the connecting member 60 is inserted in the receiving recess 226 of the first female connector 20 from an entrance end of the receiving recess 226 and the protrusions 642 of the connecting member 60 are snappingly engaged in the corresponding positioning holes 228 of the receiving recess 226. Thus the connecting member 60 is completely received in the receiving recess 226 of the first female connector 20. The dovetailing engagement between the connecting member 60 and the receiving recess 226 of the first female connector 20 prevents the connecting member 60 from disengaging from the receiving recess 226 along the directions other than the entrance end of the receiving recess 226. The electrical plugs of the first and second male connectors 82, 84 are respectively received into the heads 230, 430 of the first and second female connectors 20, 40 and electrically connected with the corresponding contact terminals of the heads 230, 430. Thus the hard disk drive 80 is electrically connected to a power supply unit and a motherboard via the cables 20, 40.

The receiving recess 426 of the second female connector 40 is aligned with the receiving recess 226 of the first female connector 20, and the connecting member 60 is pushed towards the receiving recess 426 via the finger portion 62. The positioning holes 228 of the receiving recess 226 are aligned with the positioning hole 428 of the receiving recess 426, and the distance between the positioning holes 228 of the receiving recess 226 is generally equal to the distance between the positioning hole 428 of the receiving recess 426 and the nearer positioning hole 228 of the receiving recess 226. The protrusions 642 of the connecting member 60 are disengaged from the corresponding positioning holes 228 of the receiving recess 226, and snappingly engaged in the nearer positioning hole 228 of the receiving recess 226 and the positioning hole 428 of the receiving recess 426. The connecting member 60 is dovetailed in the receiving recesses 226, 426 simultaneously, and the first and second female connectors 20, 40 are combined together.

Thus, in use, if the first female connector 20 is accidentally pulled via the cables 24, or the second female connector 40 is accidentally pulled via the cables 44, static friction between the first and second female connectors 20, 40 and the corresponding first and second male connectors 82, 84 must be overcome before disengaging from the hard disk drive 80. That is, a greater external force is needed to remove the first female connector 20 singly from the first male connector 82, or to remove the second female connector 40 singly from the second male connector 84, which effectively prevents from accidental removal of the first and second female connectors 20, 40 when in use. The electrical interconnections between the first and second female connectors 20, 40 and the corresponding first and second male connectors 82, 84 are more reliable.

During the intentional removal of the first and second female connectors 20, 40 of the electrical connector assembly from the corresponding first and second male connectors 82, 84 of the hard disk drive 80, the connecting member 60 is slid back in the receiving recess 226 of the first female connector 20 from the receiving recess 426 of the second female connector 40, and the protrusions 642 of the connecting member 60 are disengaged from the positioning hole 428 of the receiving recess 426 and the nearer positioning holes 228 of the receiving recess 226 and snappingly engaged in the positioning holes 228 of the receiving recess 226. Thus, the first and second female connectors 20, 40 can be removed singly from the corresponding first and second male connectors 82, 84.

Figure 4:
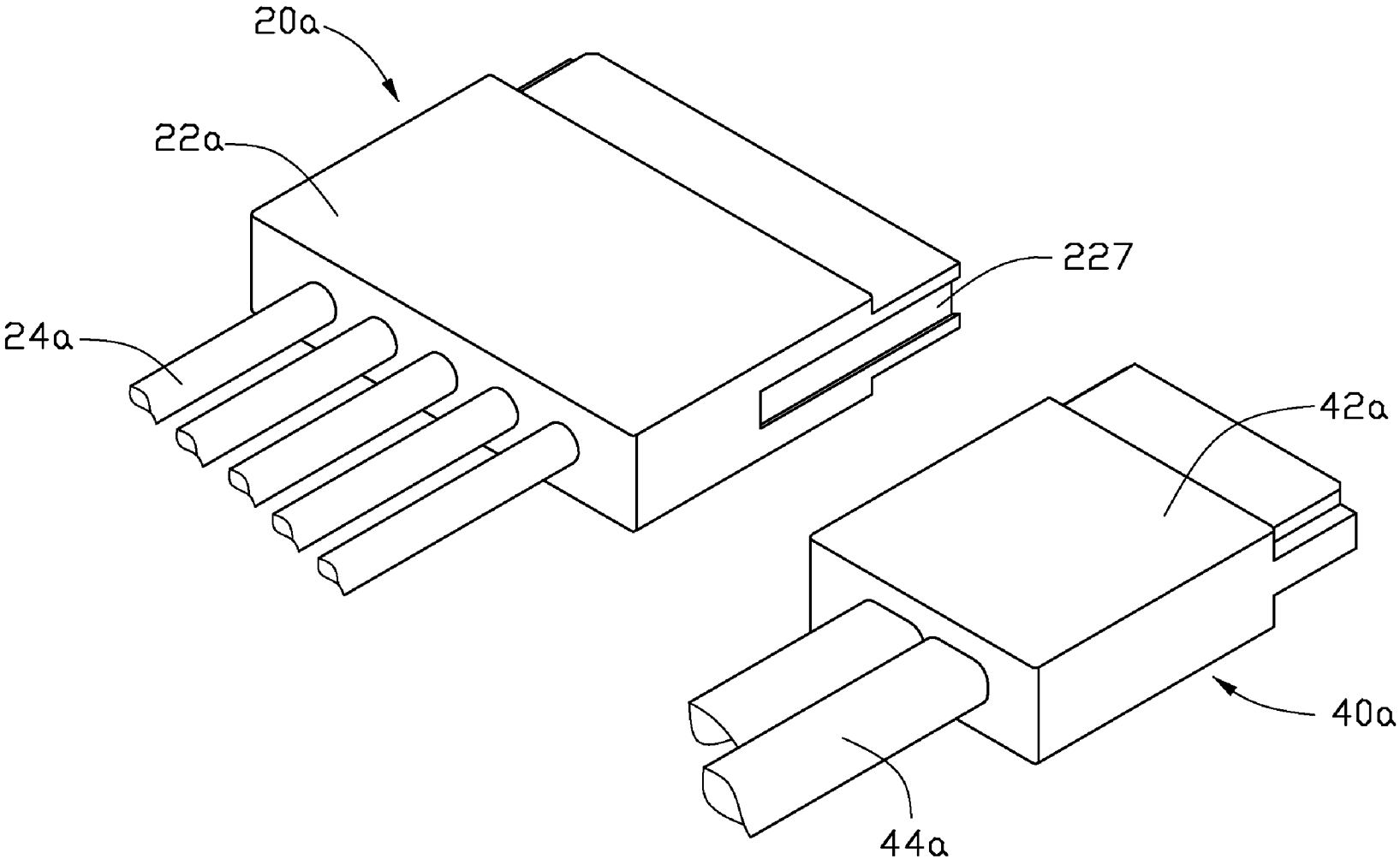
FIG. 4 is an exploded, isometric view of an electrical connector assembly according to a second embodiment.
Figure 5:
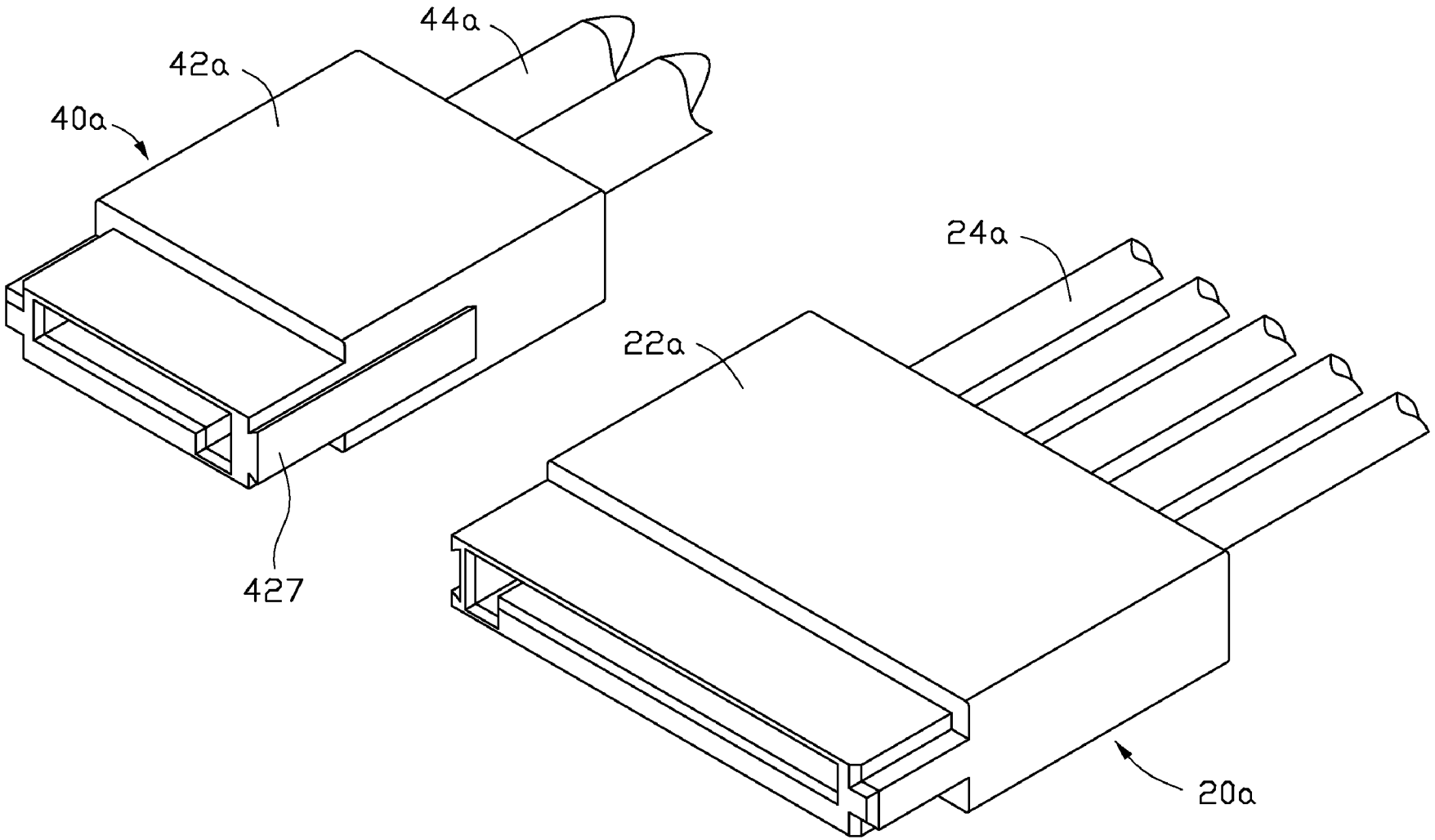
FIG. 5 is another aspect view of FIG. 4.

Referring to FIGS. 4 and 5, in a second embodiment, an electrical connector assembly includes a first female connector 20*a*, a second female connector 40*a*. The first female connector 20*a* is similar to the first female connector 20, and includes a main body 22*a* and a plurality of cables 24*a* extending from a back end thereof. An elongated groove 227 is defined at a side of the main body 22*a* and extends from a front end of the main body 22*a* towards the back end thereof. The groove 227 has a dovetail-shaped cross-section. The back of the groove 227 is dented downwardly and inwardly.

The second female connector 40*a* is similar to the second female connector 40, and includes a main body 42*a* and a plurality of cables 44*a* extending from a back end thereof. An elongated raised portion 427 is formed at a side of the main body 42*a*, opposite to the side of the main body 22*a* of the first female connector 20*a*. The raised portion 427 extends from a front end of the main body 42*a* towards the back end thereof. The raised portion 427 has a dovetail-shaped cross-section to be received in the groove 227 of the first female connector 20*a*. The back of the raised portion 427 is dented downwardly and inwardly to engage with the back of the groove 227 of the first female connector 20*a*.

In use, the second female connector 40*a* is electrically connected with the second male connector 84 of the hard disk drive 80, the hard disk drive 80 is electrically connected to a motherboard via the cables 40*a*. The groove 227 of the first female connector 20*a* is aligned with the raised portion 427 of the second female connector 40*a*, and the raised portion 427 is slidably dovetailed in the groove 227. When the first female connector 20*a* is electrically connected with the first male connector 82 of the hard disk drive 80, whereby the hard disk drive 80 is electrically connected to a power supply unit via the cables 20*a*, the first and second female connector 20*a*, 40*a* are combined together via the dovetailing engagement of the raised portion 427 in the groove 227.

Alternatively, the groove 227 may be defined in the main body 42*a* of the second female connector 40*a*, and the raised portion 427 may be formed in the main body 22*a* of the first female connector 20*a* corresponding to the groove 227.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a first electrical connector comprising an insulative main body with a receiving recess defined therein;

a second electrical connector comprising an insulative main body with a receiving recess defined therein; and a connecting member slidably engaged in the receiving recess of the first electrical connector, the connecting member being configured for being engaged in the receiving recesses of the first and second connectors simultaneously, thereby combining the first and second connectors together;

wherein two spaced positioning holes are defined in the receiving recess of the first electrical connector, a positioning hole is defined in the receiving recess of the second electrical connector in alignment with the two positioning holes, two spaced protrusions are formed at an inner surface of the connecting member and engaged in the two positioning holes in the receiving recess of the first electrical connector, when the connecting member is pushed to be simultaneously engaged in the receiving recesses of the first and second connectors, the two protrusions of the connecting member are engaged in the positioning hole in the receiving recess of the second electrical connector and the nearer positioning hole in the receiving recess of the first electrical connector, thereby the first and second connectors are combined together.

2. The electrical connector assembly as described in claim 1, wherein a finger portion including a plurality of ribs is formed at an outer surface of the connecting member to facilitate fingers pushing the connecting member.

3. The electrical connector assembly as described in claim 1, wherein a dovetailing engagement is provided between the connecting member and the receiving recesses of the first and second connectors configured for preventing the connecting member from being disengaged from the receiving recesses of the first and second electrical connectors.

4. The electrical connector assembly as described in claim 3, wherein the receiving recesses of the first and second electrical connectors have a dovetail-shaped cross-section, and the connecting member has a dovetail-shaped cross-section configured for being slidably engaged in the receiving recesses of the first and second electrical connectors.

5. An electrical device assembly comprising:

an electrical device having a first and second mating connectors;

a first electrical connector being engaged with the first mating connector and comprising a cable extending therefrom, a receiving recess being defined in the first electrical connector;

a second electrical connector being engaged with the second mating connector and comprising a cable extending therefrom, a receiving recess being defined in the second electrical connector; and a connecting member being slidably engaged in the receiving recesses of the first and second connectors simultaneously, thereby combining the first and second connectors together;

wherein two spaced positioning holes are defined in the receiving recess of the first electrical connector, a positioning hole is defined in the receiving recess of the second electrical connector in alignment with the two positioning holes, two spaced protrusions are formed at an inner surface of the connecting member and engaged in the positioning hole in the receiving recess of the second electrical connector and the nearer positioning hole in the receiving recess of the first electrical connector, when the connecting member is pushed to be singly engaged in the receiving recess of the first electrical connector, the two protrusions of the connecting member are engaged in the two positioning holes in the receiving recess of the first electrical connector, thereby the first and second electrical connectors are separated from each other.

6. The electrical device assembly as described in claim 5, wherein a dovetailing engagement is provided between the connecting member and the receiving recesses of the first and second connectors configured for preventing the connecting member from being disengaged from the receiving recesses of the first and second electrical connectors.

7. The electrical device assembly as described in claim 5, wherein the receiving recesses of the first and second electrical connectors have a dovetail-shaped cross-section, and the connecting member has a dovetail-shaped cross-section to be slidably engaged in the receiving recesses of the first and second electrical connectors.

8. The electrical device assembly as described in claim 5, wherein a finger portion including a plurality of ribs is formed at an outer surface of the connecting member to facilitate finger pushing the connecting member.

* * * * *